US005127474A

United States Patent [19]

Schroeder, Jr. et al.

[11] Patent Number: 5,127,474

[45] Date of Patent: Jul. 7, 1992

[54] METHOD AND MEANS FOR STABILIZING GRAVEL PACKS

[75] Inventors: Donald E. Schroeder, Jr., Littleton, Colo.; Brian A. Butler, Lafayette, La.

[73] Assignee: Marathon Oil Company, Findlay, Ohio

[21] Appl. No.: 627,180

[22] Filed: Dec. 14, 1990

[51] Int. Cl.[5] ..... E21B 43/04

[52] U.S. Cl. ..... 155/278; 166/51; 166/151; 166/205; 166/324; 166/325

[58] Field of Search ..... 166/278, 51, 116, 115, 166/148, 151, 205, 238, 321, 324, 325

[56] References Cited

U.S. PATENT DOCUMENTS

| | | | |
|---|---|---|---|
| 2,144,842 | 1/1939 | Hanes | 166/151 X |
| 2,251,244 | 7/1941 | Stanley | 166/151 X |
| 2,363,290 | 11/1944 | Bridwell | 166/238 |
| 2,870,843 | 1/1959 | Rodgers | 166/115 |
| 2,897,897 | 8/1959 | Breukelman | 166/148 X |
| 2,906,338 | 9/1959 | Shook | 166/148 X |
| 2,978,027 | 4/1961 | Widmyer | 166/51 |
| 3,313,350 | 4/1967 | Page | 166/151 X |
| 3,421,586 | 1/1969 | Solum | 166/51 |
| 3,474,859 | 10/1969 | Chenoweth | 166/115 X |
| 3,952,804 | 4/1976 | Smyrl | 166/278 |
| 4,378,842 | 4/1983 | Patel | 166/278 |
| 4,633,944 | 1/1987 | Zunkel et al. | 166/278 X |
| 4,721,162 | 1/1988 | Pringle et al. | 166/321 X |

OTHER PUBLICATIONS

Understanding Changing Wellbore Pressures Improves Sand Control Longevity, SPE 14160, 60th Annual Conference, Soc. Pet. Engrs, Sep. 1985.

*Primary Examiner*—Ramon S. Britts
*Assistant Examiner*—Roger J. Schoeppel
*Attorney, Agent, or Firm*—Jack L. Hummel; Jack E. Ebel

[57] ABSTRACT

Method and means for preventing fluidization or mobilization of a gravel pack in a fluid producing well as a result of increased fluid pressure caused by a well shut-in or other pressure surge. A pressure relief valve in the form of a check valve is provided in a tubing string below a packer surrounding the string and above the top of the gravel pack. The check valve is held in closed position by a biasing force, such as a spring, which is less than the pressure which will cause mobilization or fluidization of the gravel pack. A pressure surge such as a well shut-in or flow rate decrease increases tubing pressure which causes the check valve to open, thereby relieving the pressure in the gravel pack to a point below the critical level.

6 Claims, 2 Drawing Sheets

METHOD AND MEANS FOR STABILIZING GRAVEL PACKS

FIELD OF THE INVENTION

This invention relates to fluid production wells. More particularly, it relates to fluid production wells which employ gravel packs to prevent the production of sand in conjunction with well fluids.

BACKGROUND OF THE INVENTION

The inclusion of sand with the well fluids produced from an unconsolidated subterranean oil or gas producing zone has long been a problem in the petroleum industry. It can cause erosion of production equipment and can plug the well, causing reduced production levels or loss of well production entirely.

An effective means of combating the problem is the gravel pack, which involves placing a tubular liner in the well bore and packing gravel around it. The liner has slots or other apertures in its walls which are smaller in size than the gravel particles so as to permit the flow of formation fluids while preventing entry of the particles. Typically, the gravel particles are designed to be of a size that will exclude median formation grain size. Thus the gravel pack and screen are designed for absolute exclusion of formation particles and gravel particles from the liner.

In addition, modern methods of predicting gravel size requirements have resulting in reduced gravel pack damage caused by formation particle invasion. Despite improved gravel pack technology, however, damaged gravel packs continue to be a problem. Even with proper gravel sizing, any porosity fluctuation resulting from fluidization with an associated change in the steady rate of fluid flow may cause formation particle release or failure of the formation with its subsequent flow into any open porosity or void in the perforations or annulus. Complete failure of the gravel pack may occur when a pressure surge causes movement of the gravel up the lap area, thereby exposing the liner directly to sand particles, which it is not designed to retain. The lap area in this case is the annular space between the top of the gravel pack and the packer through which the production tubing extends.

The most common cause of severe pressure surges is the shut-in of a well. Normally, when production commences after a gravel pack has been installed the pressure inside the liner will decrease due to the various pressure drops encountered by the fluid as it flows through the well. As a result, fluid will flow down from the lap area through the gravel pack and into the liner to equalize the pressure. When the well is shut in, however, the well bore pressure builds up to essentially the reservoir pressure and, for the pressure of the lap area to equalize to the reservoir pressure, fluid flow will occur from the formation up the gravel pack and into the lap area. If the pressure build-up is too rapid, the fluid velocity up the lap area can be great enough to mobilize or fluidize the gravel. It should be understood that the use of either term "mobilize" or "fluidize" in the specification and claims is not intended to be restricted to any particular type of gravel movement but to pertain to flowable movement in general, including movement as a result of the particles being suspended in a carrier medium.

The significance of the problem can be placed in perspective when it is realized that wells are shut in many times each year, some due to operating requirements but many more due to being instantaneously shut in by emergency shut-down systems, which become operative in response to pressure fluctuations or facility upsets or to adverse weather conditions. When such wells are returned to production, a decrease in productivity may occur, possibly even to the extent of completely losing production, due to sanding-up of the well.

It has been suggested that by determining the minimum velocity required to cause fluidization of a gravel bed, the minimum shut-in time which produces this velocity can be calculated. Then, by taking steps to ensure that the shut-in process is longer in duration than the calculated minimum shut-in time, fluidization can be prevented. As a practical matter the implementation of such a shut-in process is not only time consuming but is not possible in the many emergency instantaneous shut-in situations referred to above.

It has also been suggested that a consolidated gravel pack capable of withstanding severe pressure surges and fluid velocities without fluidizing the gravel be employed to solve this problem. Consolidated gravel packs can be implemented by utilizing gravel which has been coated with uncured resin or by incorporating a liquid resin system in a normal gravel pack slurry. Consolidated gravel packs have the advantage of permitting rapid shut-in, but are significantly more expensive than ordinary gravel packs. Further, consolidation systems have the disadvantage of lower permeability and porosity and possible formation damage due to coating failure when subsequent chemical stimulation is required. Air curing is also necessary in many cases to develop a high strength resin bond which will not fail. Curing the resin systems under in situ conditions can also result in a less competent resin coating.

It would be highly desirable to be able to prevent fluidization or mobilization of normal gravel packs without interfering with the action of emergency shut-down systems which cause instantaneous shut-in of a well. It would also be advantageous to be able to accomplish this in an economical and reliable manner.

BRIEF SUMMARY OF THE INVENTION

The invention has utility in fluid production wells and in steam, water or thermal injection wells. Basically, it comprises a well bore penetrating a subterranean producing zone, a tubing string extending through the well bore from the surface, gravel pack liner tubing connected to the tubing string, a gravel pack in the annulus between the gravel pack liner tubing and the well bore, and a packer which surrounds the tubing string at a point above the gravel pack. According to the invention, pressure relief valve means are provided in the tubing string at a location between the packer and the gravel pack, with the valve means being normally closed but adapted to open in response to increased fluid pressure in the gravel pack caused by a pressure surge such as that created with a well shut-in or rate change.

The pressure relief valve means preferably is one or more check valves biased in their closed position by a force less than the pressure which will cause the gravel pack to move or fluidize, e.g. by unloading, etc. When the valves open the differential pressure in the gravel pack is lessened, with the result that the pressure necessary to cause fluidization of the gravel pack is not reached.

The pressure relief valve means is located so that it does not interfere with normal operation of the well, including the introduction of gravel, the flow of well fluids and the movement of tools through the tubing. Although implementation of the invention is economical and relatively simple, the invention is highly effective in preventing movement of the gravel pack.

The features enabling the invention to function in the desired manner are brought out in more detail below in connection with the description of the preferred embodiment, wherein the above and other aspects of the invention, as well as other benefits, will readily be apparent.

DETAILED DESCRIPTION OF THE PREFERRED EMBODIMENT

Figure 1:
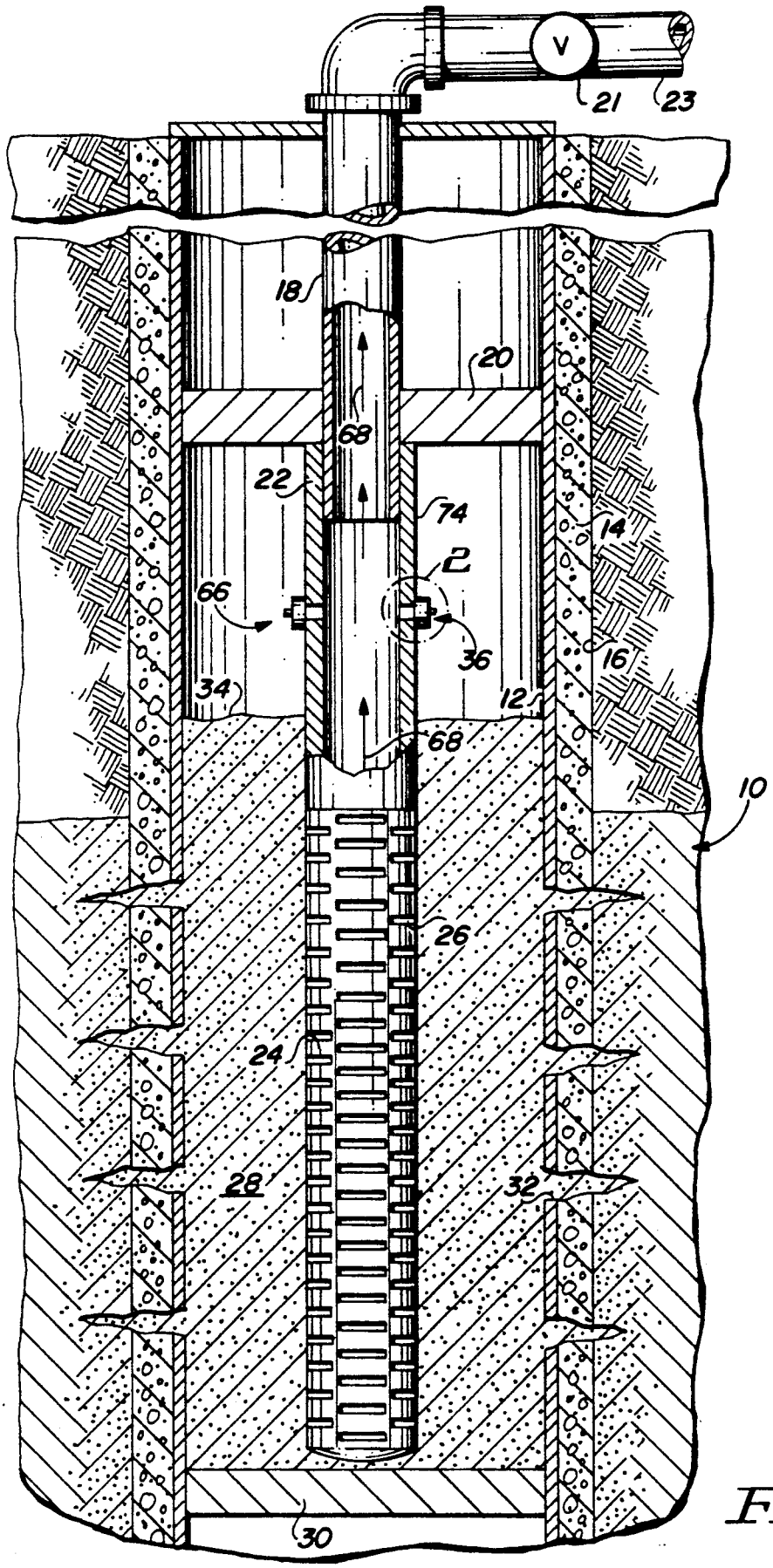
FIG. 1 is a schematic partial longitudinal sectional view of a typical well incorporating a gravel pack and the fluidization prevention means of the invention.

Referring to FIG. 1, a portion of a typical subterranean oil or gas production well which penetrates a production formation 10 is illustrated in schematic form as comprising casing 12 cemented by a layer of cement 14 to the well bore 16. A tubing string 18 extends from the surface down to a point below packer 20, which surrounds the tubing string 18, at least partially supporting it and sealing the annulus between the tubing string and the casing. Although the details are not shown, it will be understood that the necessary equipment for operating the well located at the surface is in place. A shut-off valve 21 is shown in the fluid line 23 which when closed during production of the well will result in the well being shut in.

The tubing string 18 extends below the packer 20 into the upper end portion of blank pipe 22, which hangs from the packer 20 by conventional means well known in the art. The lower portion of the blank pipe 22 comprises a liner 24 which includes slits, wire wrapped screens or other form of apertures 26. Surrounding the liner 24 is a bed of gravel 28 supported on packer 30. Preferably, the gravel may also extend into production perforations 32 in the casing 12 and cement 14 through which production fluid from the surrounding formation 10 flows. The gravel may also extend into cavities in the formation surrounding the cement depending upon the structure of the formation 10.

The body of gravel resting on the packer 30 and terminating at its upper level 34 constitutes the gravel pack which functions in the normal manner to prevent the entry of sand particles into the gravel pack liner tubing 24. Located above the top of the gravel pack at a point in the blank pipe 22 below the packer 20 is pressure relief valve means 36. This valve means may be of any suitable design, as long as it is capable of remaining normally closed and functions to open upon the differential pressure across it reaching a predetermined level. Also, it is preferred that the design be such that washpipe or wireline tools can be freely moved through the passageway of the tubing 24 without obstruction by the valve means.

Figure 2:
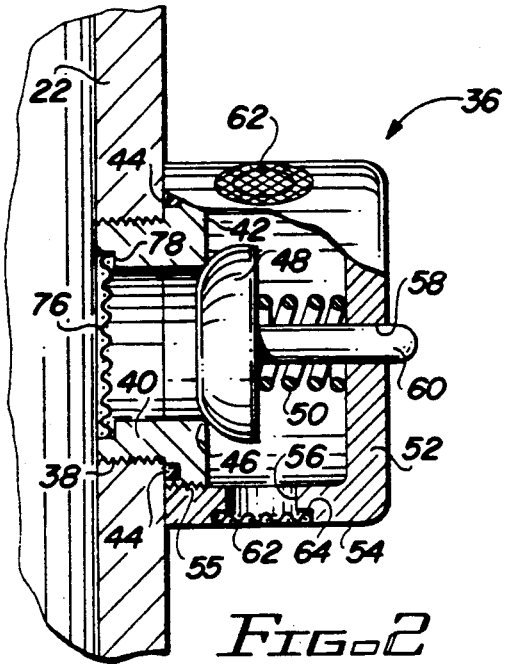
FIG. 2 is an enlarged partial transverse sectional view of the area of FIG. 1 enclosed in the circle 2, illustrating a valve which can be used in the invention, the valve being shown in closed condition.

Referring to FIG. 2, the valve arrangement 36 comprises a threaded circular port 38 in the blank pipe 22 which receives a threaded sleeve 40. The sleeve includes an integral flange 42 which engages the external surface of the blank pipe 22 and which is sealed against the passage of fluids by suitable means, such as O-ring 44. The outer portion of the sleeve functions as a valve seat 46 for a valve element 48 which is normally urged into engagement with the valve seat by compression spring 50. The compression spring is supported at its opposite end by a cover or cap 52 having a cylindrical extension 54 engaged by threads 55 with the outer periphery of the flange 42. The cylindrical extension 54 is provided with a number of openings 56, and the cap 52 is provided with a centrally located opening 58 which functions as a bushing for receiving the valve stem 60.

Figure 3:
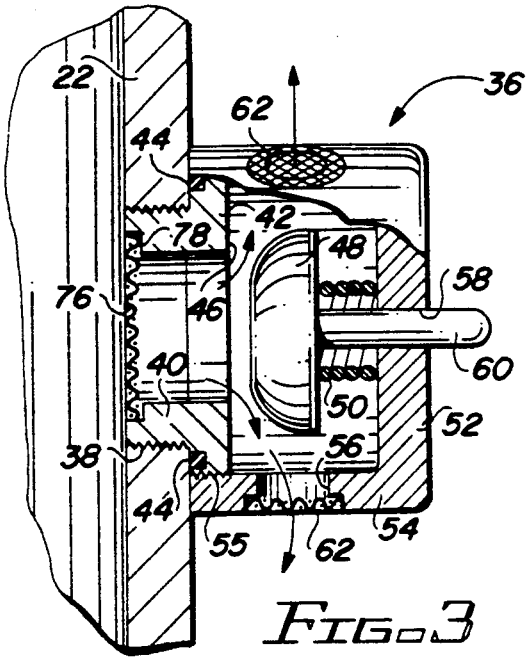
FIG. 3 is an enlarged partial transverse sectional view similar to that of FIG. 2, but showing the valve in open condition.

In the operation of the valve, when the fluid pressure in the blank pipe 22 is greater than the force exerted by the spring 50, the fluid pressure will force the valve element 48 off the valve seat 46 against the force of the spring, with the valve stem moving out through the opening 58 to accommodate such action. The valve at this point would appear as illustrated in FIG. 3. It can be seen that fluid in the tubing 22 will now flow through the open valve seat and out the openings 56 as indicated by the flow arrows. This will continue until such time as the force of the spring is greater than the fluid pressure in the tubing 22, at which time the valve will again close. Obviously, although only two check valves have been shown in FIGS. 1, 2 and 3 for purpose of illustration, as many as necessary may be provided.

Still referring to FIGS. 2 and 3, circular screens 62 are provided in circular recesses or counterbores 64 surrounding the openings 56 of the cylindrical extension 54. By making the openings or mesh of the screen 62 less than the size of the particles in the gravel fluid, the valve will not be fouled by the gravel placement process. If desired, a screen 76 may also be provided at the valve inlet, such as in recess or counterbore 78 in sleeve 40, but this is not considered an essential element since normally no gravel would be present on the inside of the tubing to foul the valve.

Although the valve design of FIGS. 2 and 3 has been described in detail, it will be understood that other types of pressure relief valves could be used instead. For example, a ball and cage spring type check valve could be utilized to take advantage of the fact that the ball rotates and seats in many different positions, spreading the wear over a large area. This would be of special utility in abrasive service environments such as the one under discussion.

Referring back to FIG. 1, prior to beginning production after having placed the gravel pack 28, the fluid trapped in the lap area 66 after the packing has settled causes the pressure in the lap area 66 and in the gravel pack 28 to be substantially equal. Upon beginning production, the pressure in the gravel pack is reduced by reservoir and completion drawdown, which causes the higher pressure fluid in the lap area to be produced as the fluid pressures in the lap area and in the gravel pack seek to be equalized. The eventual substantially steady-state production operation is illustrated in FIG. 1, whereby production fluid flows up to the surface through the tubing 22 and 18 as indicated by the flow arrows 68. If the well is abruptly shut in by the closure of valve 21, the pressure in the gravel pack will increase to static reservoir pressure, creating a tendency for the fluid in the gravel pack to flow into the lap area in an attempt to equalize pressures within the well. When the pressure differential is sufficient and the pressure surge is rapid enough, fluidization or mobilization of the gravel pack, with all the attendant problems, occurs.

Figure 4:
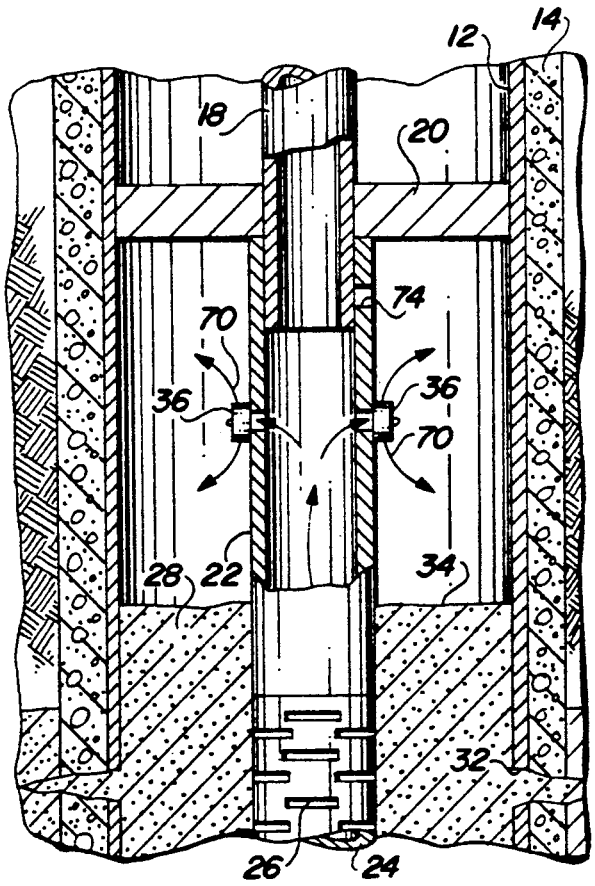
FIG. 4 is a schematic partial longitudinal sectional view similar to that of FIG. 1, but showing the pressure relief action of the valve means of the invention during a period of increased pressure.

Fluidization upon well shut-in does not occur when the arrangement of the present invention is employed. Referring to FIG. 4, when the pressure of the fluid in the gravel pack increases to a critical predetermined point, the pressure in the fluid traveling up the blank pipe 22 will exceed the force exerted by the check valve springs 50 and will flow out the check valves into the lap area 66 as indicated by the flow arrows 70. This immediately increases the pressure in the lap area and minimizes fluid movement from the gravel pack to the lap area sufficiently to forestall gravel pack movement. Fluid will continue to flow through the check valves 36 into the lap area until the fluid pressures in the lap area and the gravel pack are equalized. Upon the well being placed back into production, the gravel pack will be intact at full productivity because small formation sand will not have mixed with the coarser gravel of the gravel pack, which would severely reduce the gravel permeability. Further, sand will not be produced because it will not have found its way into the liner tubing during the well shut-in.

Figure 5:
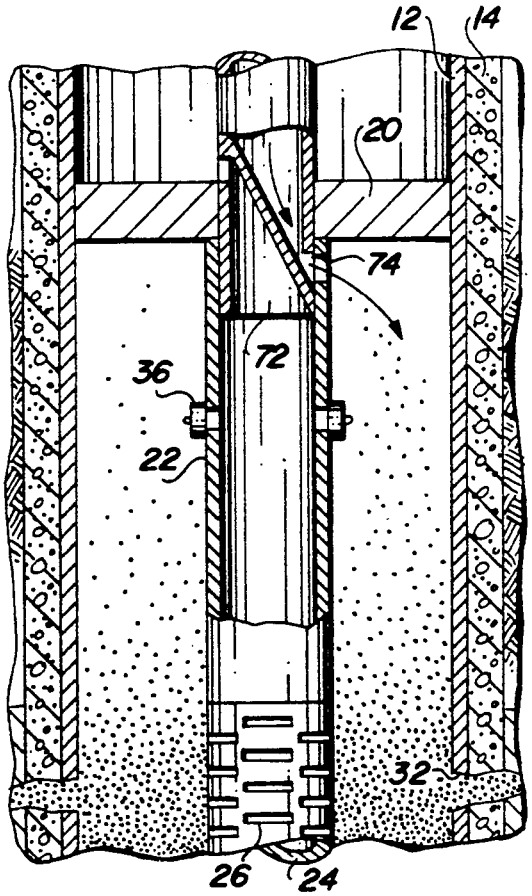
FIG. 5 is a schematic partial longitudinal sectional view similar to that of FIG. 1, but showing the valve means of the invention during the step of gravel introduction.

The presence of the pressure relief valve assembly need not interfere with the introduction of gravel. As shown in FIG. 5, a gravel slurry will typically be introduced through a crossover tool 72 aligned with outlet port 74 in the blank pipe 22. Because the outlet port is located above the valves 36, the valves do not interfere with the application of the gravel pack. After the gravel has been placed, the crossover tool 72 is removed and replaced by the section of the tubing string shown in FIG. 1. The normal operating arrangement is such that the port 74 is overlapped by the end portion of the tubing 18. The port 74 thus has no function after allowing gravel to be delivered through the crossover tool during application of the gravel pack. The valves 36 must, however, be located below the port 74 so as to be exposed to the pressure of the production fluid as it flows up the blank pipe 22. For stimulation work requiring the injection of fluids, the work string packer or tubing packer could be set below or across the crossover ports and the pressure relief valves to isolate them from the system. This would allow fluid injection only over the perforated interval and not through the pressure relief valve or crossover ports.

As indicated above, the force applied by the check valves 36 should be less than the fluid pressure which will cause the gravel pack to become mobile or fluidized. This can be calculated for any particular well by known procedures, including the determination of the minimum pressure drop required for fluidization, as set forth in SPE 14160, a paper of the Society of Petroleum Engineers entitled "Understanding Changing Wellbore Pressures Improves Sand Control Longevity", which was presented at the meeting of the Society of Petroleum Engineers of Sep. 22–25, 1985.

Although the invention has particular utility in the type of well described above, it can also be used in thermal wells in which steam is injected. The valve of the present invention would help eliminate fluidization of the gravel pack when pressures are unbalanced at the time steam flow is first started into the well. During the production cycle of such a well, the valve would close, thus preventing fluidization of the gravel pack again. It will be understood by those skilled in the art that the invention may also have utility in equalizing pressure in horizontal wells.

It can now be appreciated that the present invention provides a simple yet effective way of eliminating the fluidization of gravel packs caused by pressure surges resulting from a well shut-in. It should also be appreciated after reading the foregoing description that the invention is not necessarily limited to all the specific details described in connection with the preferred embodiment, but that changes to certain features which do not alter the overall basic function and concept of the invention may be made without departing from the spirit and scope of the invention, as defined in the appended claims.

What is claimed is:

1. In a fluid production or injection well comprising a well bore penetrating a subterranean producing zone, gravel pack liner tubing in the well bore having apertures therein, a gravel pack in the annulus between the liner tubing and the well bore, a tubing string connected to the liner tubing through which produced fluid can flow, and a packer surrounding the tubing string at a location spaced above the gravel pack, the improvement comprising:

pressure relief valve means in the tubing string located between the packer and the gravel pack, the pressure relief valve means being normally closed but adapted to open in response to increased differential pressure across the gravel pack and liner tubing caused by a pressure surge to thereby allow produced fluid to flow outwardly through the open pressure relief valve means;

the pressure relief valve means comprising a check valve located radially outwardly of the inside diameter of the tubing string; and the check valve including a screen covered outlet opening in the check valve for preventing entry of particulate matter larger than the screen size into the check valve while the check valve is open.

2. A method of preventing fluidization or mobilization of a gravel pack in a fluid production or injection well upon the well experiencing a pressure surge, wherein the well includes a well bore penetrating a subterranean fluid producing zone, gravel pack liner tubing located within the gravel pack and having apertures therein through which production fluid can flow, a tubing string connected to the liner tubing through which production fluid can flow, and a packer surrounding the tubing string at a location spaced above the gravel pack, the method comprising the steps of:

providing valve means in the tubing string between the packer and the gravel pack;

maintaining the valve means closed at the differential pressures encountered during normal production of the fluid; and opening the valve means in response to increased differential pressure across the gravel pack and liner tubing caused by the pressure surge to thereby allow production fluid in the tubing string to flow outwardly through the open valve means.

3. The method of claim 2, wherein the valve means comprises pressure relief valve means, the pressure relief valve means opening at a pressure which is less than the pressure calculated to cause the gravel pack to become mobile.

4. The method of claim 3, wherein the pressure relief valve means comprises a check valve located radially outwardly of the inside diameter of the tubing string.

5. A method of preventing fluidization or mobilization of a gravel pack in a fluid production well, comprising the steps of:

providing gravel pack liner tubing in a well bore which penetrates a subterranean fluid producing zone, the liner tubing being connected to production tubing extending upwardly through the well bore;

providing valve means in the production tubing below a packer surrounding the production tubing and above the eventual height of the gravel pack;

forming a gravel pack by introducing gravel into the well bore through the production tubing by means of a crossover tool connected to the production tubing at a location below the packer and above the valve means, the crossover tool having an outlet opening aligned with a port in the production tubing;

removing the crossover tool and covering the crossover port in the production tubing;

the valve means being closed at the differential pressures encountered during introduction of the gravel and during production of the fluid; and opening the valve means in response to a predetermined level of increased differential pressure across the gravel pack and liner tubing caused by a pressure surge to thereby allow fluid in the production tubing to flow outwardly through the open valve means, said predetermined level being less than the calculated pressure at which the gravel pack becomes mobile.

6. The method of claim 5, wherein the valve means comprises a check valve held in normally closed condition against a valve seat by a biasing force, the biasing force corresponding to said predetermined level of increased differential pressure.

* * * * *